United States Patent [19]

Boldebuck et al.

[11] 4,032,420

[45] June 28, 1977

[54] METHOD OF RESTORING OR MAINTAINING AN ELECTROCOATING BATH

[75] Inventors: Edith M. Boldebuck, Schenectady; Catherine W. Joynson, Alplaus, both of N.Y.

[73] Assignee: General Electric Company, Schenectady, N.Y.

[22] Filed: Dec. 17, 1975

[21] Appl. No.: 641,624

[52] U.S. Cl. ..... 204/181

[51] Int. Cl.[2] ..... C25D 13/24

[58] Field of Search ..... 204/181

[56] References Cited

UNITED STATES PATENTS

| | | | |
|---|---|---|---|
| 3,419,488 | 12/1968 | Cooke | 204/181 |
| 3,682,806 | 8/1972 | Kinsella et al. | 204/181 |
| 3,810,858 | 5/1974 | Boldebuck | 204/181 |
| 3,855,169 | 12/1974 | Lupinski et al. | 204/181 |

FOREIGN PATENTS OR APPLICATIONS

| | | | |
|---|---|---|---|
| 23,655 | 1973 | Japan | 204/181 |

*Primary Examiner*—Howard S. Williams
*Attorney, Agent, or Firm*—William A. Teoli; Joseph A. Cohen; Jerome C. Squillaro

[57] ABSTRACT

A method is described for maintaining or restoring a polyamide acid salt electrocoating bath which has either deteriorated, or is being used continuously for electrocoating purposes. Improved results are achieved by flowing the electrocoating bath through an anion exchange resin having a particular cross-link density thereby maintaining or increasing the weight percent solids generated in the electrodeposit.

7 Claims, 1 Drawing Figure

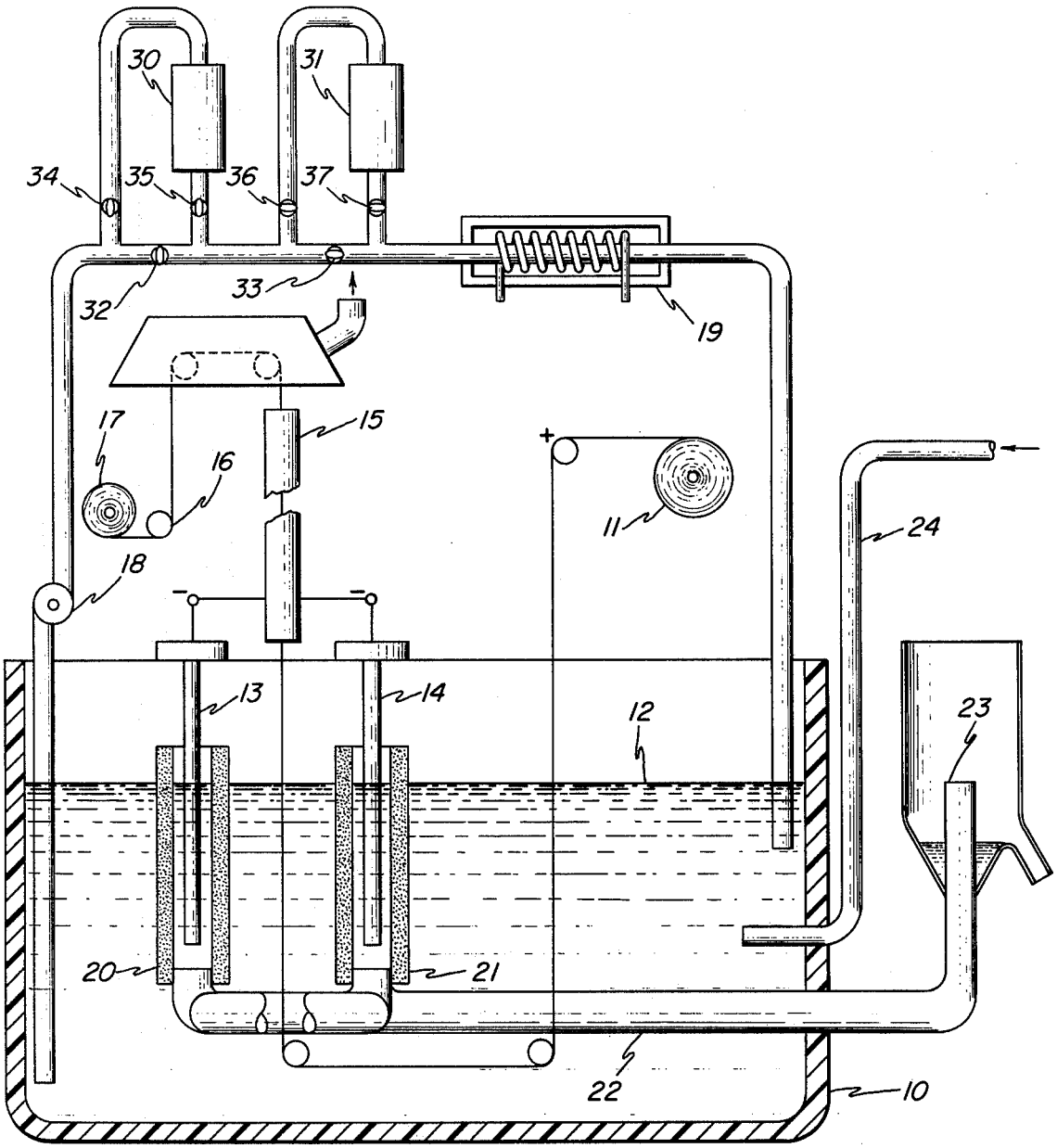
30
31
34
35
36
37
32
33
19
17
16
15
11
24
18
13
14
12
23
20
21
22
10

METHOD OF RESTORING OR MAINTAINING AN ELECTROCOATING BATH

The present invention relates to a method of rejuvenating a polyamide acid salt electrocoating bath which has deteriorated. The present invention more particularly relates to a method of maintaining a polyamide acid salt electrocoating bath for continuous electrocoating purposes by flowing the bath through an anion exchange resin having a particular cross-link density.

Prior to the present invention various procedures have been described for overcoming the problems associated with storing polyamide acid salt mixtures for an extended period of time. As taught by U.S. Pat. No. 3,767,550, Boldebuck, assigned to the same assignee as the present invention, polyamide acid mixtures, such as dispersions and solutions, can degrade rapidly at ambient temperatures, i.e., between 25° C to 35° C if they have a sufficient number of chemically combined nonneutralized amide acid units of the formula,

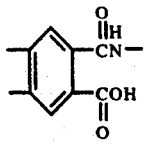

One procedure is to maintain the polyamide acid salt mixture at a temperature of between about −15° C to +15° C to retard the degradation rate of the aqueous polyamide acid mixture which can result in a breakdown of the polyamide acid backbone. Another procedure is shown by Boldebuck U.S. Pat. No. 3,810,858, also assigned to the same assignee as the present invention, which provides for the separation and reuse of the emulsified polyamide acid solids. A further technique which has been developed is shown by Boldebuck U.S. Pat. No. 3,737,478, also assigned to the same assignee as the present invention, which is based on the addition of a strong base to a completely imidized polymer to give completely neutralized amide acid salt groups in the polyamide acid polyimide backbone. Although the aforementioned techniques provide for improved results in particular situations, a satisfactory procedure has not been found which can be employed to maintain, or restore a polyamide acid salt electrocoating bath, which is being used on a continuous basis with completely neutralized or partly neutralized polyamide acid compositions.

The present invention is based on the discovery that improved results can be achieved with certain anion exchange resins having a cross-link density sufficient to contain from about 50–70% by weight water, based on the total weight of water and dry weight of resin, after the resin has been completely immersed in water and thereafter separated from the water by a standard technique, such as filtration, etc. Restoration of deteriorated polyamide acid salt bath can be achieved by flowing the polyamide acid salt bath through a bed of the aformentioned anion exchange resin. The polyamide acid salt bath as a result can be restored or maintained to provide for an electrodeposit having at least 15% by weight solids; nonneutralized carboxylic acid arising from the breakdown of polyamide acid units in the polymer backbone can be reduced to a level of less than 0.45 meq of excess titratable nonneutralized carboxylic acid, per gram of polyamide acid salt.

There is provided by the present invention a method of restoring or maintaining a polyamide acid salt electrocoating bath capable of providing an electrodeposit having at least 15% by weight solids which comprises, 1. flowing the polyamide acid salt electrocoating bath through an anion exchange resin, and 2. recovering a polyamide acid salt bath from (1) having less than 0.45 meq of excess titratable nonneutralized carboxylic acid, per gram of polyamide acid.

Some of the polyamide acid salt compositions which can be treated in accordance with the practice of the present invention are shown by Boldebuck U.S. Pat. No. 3,737,478, assigned to the same assignee as the present invention. As taught by Boldebuck, a variety of polyimides can be converted to polyamide acid salts by adding a base to the polyimide at a temperature up to about 150° C while the polyimide is substantially dissolved in a solvent, such as a dipolar aprotic organic solvent. Some of the polyimides which can be modified in accordance with the aforementioned Boldebuck method are, for example, polyimides shown by Edwards U.S. Pat. Nos. 2,710,853, 2,867,609, etc. In addition to the aforementioned polyamide acid salts which can be derived from polyimides, polyamide salt compositions made by effecting reaction between organic dianhydrides, such as benzophenone dianhydride, pyromellitic dianhydride, etc., and organic diamines, such as metaphenylenediamine and alkalenediamines, such as shown by Holub U.S. Pat. No. 3,507,765, also assigned to the same assignee as the present invention, can be treated in accordance with the method of the present invention to restore or maintain such polyamide acid for electrocoating purposes.

Some of the dipolar aprotic organic solvents which can be used in combination with the aforementioned polyamide acid salts are, for example, N,N-dimethylformamide, N,N-dimethylacetamide, N,N-diethylformamide, N,N-diethyl-acetamide, N,N-dimethylmethoxy acetamide, N-methyl caprolactam, dimethylsulfoxide, N-methyl-2-pyrrolidone, tetramethyl urea, pyridine, dimethylsulfone, tetramethylene sulfone, N-methylformamide, N-acetyl-2-pyrrolidone.

The anion-exchange resins which can be employed in the practice of the method of the present invention are preferably the styrene-divinylbenzene type resins with quaternary ammonium functionality. The anion-exchange resins employed in the method of the present invention can be further characterized in being a macrorecticular structure or a gel structure with relatively low cross-link density. The anion-exchange resins employed in the method of the present invention are also inert towards the aqueous organic solvent mixture in the electrocoating composition. In order to determine whether a particular anion-exchange resin can be employed in the present invention, 1–5 grams of the resin in its chloride form is fully immersed in water and allowed to rest for at least 24 hours. The excess water is then decanted off and excess visible water remaining on the surface of the resin can be removed by a standard technique, such as vacuum stripping, etc. The fully hydrated resin is then weighed. It is then heated for 8 hours at 100° C to determine the weight loss of water. Satisfactory resins are resins experiencing a weight loss of at least 50% and preferably 50–70% of water, based on the total weight of the hydrated resin. In order to convert the resin from the chloride form to the hydroxide form, a standard treatment with a 2 N aqueous sodium hydroxide solution can be employed requiring the washing of the treated resin and elimination of all chloride which can be determined by the use of an aqueous silver nitrate solution, and followed by washing with distilled water to remove residual NaOH.

A more complete understanding of the method of the present invention can be obtained by reference to the drawing showing the passage of an electroconductor in the form of round or square wire of flat strip into a polyamide acid salt bath, between two semi-permeable membrane enclosed electrodes, and its passage from the bath to a curing tower. Polyamide acid mixture is pumped from the bath to an anion exchange column above before it is returned to the bath in a continuous manner.

In the practice of the invention, one or more electroconductors, for example, copper or aluminum wire having AWG size of from 8–52, aluminum strip, magnet wire, aluminum foil, etc., is unwound from roller 11, and passed into the polyamide acid salt bath at 12 contained in tank 10, between cathodes 13 and 14 and up through curing tower 15, the cured strip is wound on roller 17 after being actuated by driver 16 in a uniform manner. As used hereinafter, the term "foil" signifies a structure having a thickness of 0.2 to 7 mil, while strip has a thickness greater than 7 mil.

The power supply not shown can be varied between 50 to 350 volts depending upon the speed of the conductor through the bath, the thickness of the polyamide acid film on the surface of the electroconductor, the number of electroconductors coated at one time, etc.

Agitation and temperature control of the bath is achieved with pump 18 and cooling coil 19. Semipermeable membranes 20 and 21, each of which can represent one of a series to provide uniform base and plural solvent transport to respective cathode compartments. Cathode compartments contain cathode elements 13 and 14, which also individually can represent one of a series to provide a more uniform current density in the bath to effect a more even electrodeposition on one or more electroconducting substrates. In addition, solvent and base removal means are situated at the bottom of each membrane which have a common connecting means 22 to overflow tube 23.

Depending upon such factors as the speed of the electroconductor through the bath, the applied voltage, the type of semi-permeable membrane, etc., the rate at which solvent and base removal can be achieved when overflow occurs at 23, as a result of electroosmotic pressure causing an increase in level within the cathode compartment over the height of level 12, can vary widely.

Replenishment of the bath can be achieved through duct 24 which is joined to make-up polyamide acid reservoir not shown. However, the bath can be continuously maintained by use of anion exchange columns 30 and 31 which can be used alternatively based on the opening and closing of valves 32–37.

In the practice of the invention a polyamide acid salt bath, which cannot provide an electrodeposit having at least 15% by weight solids, can be restored by treating it with the anion exchange resin. Excess amounts of anion exchange resin can be employed. While under batch conditions, it has been found that a proportion of from about 1 to 15 parts of anion exchange resin, per hundred parts of bath will be effective. The resin can be added to the bath at temperatures in the range of 20° to 50° C and agitated, such as by stirring for 1 to 4 hours. Restoration is achieved when the polyamide acid salt mixture is found to have less than 0.45 meq of excess titratable nonneutralized carboxylic acid per gram of polyamide acid salt. The technique which can be used to titrate the nonneutralized carboxylic acid species in a polyamide acid salt mixture is as follows:

A portion of electrocoating formulation dissolved in dimethyl formamide is titrated with methanolic tetrabutyl ammonium hydroxide, using a potentiometric titrator and titrating to a final end point described in Boldebuck U.S. Pat. No. 3,892,716, assigned to the same assignee as the present invention. The titrated species will include nonneutralized amide acid, imide, carboxylic acid salts of weak base, such as amine, and acidic hydrolysis products, but does not include carboxylic acid species neutralized with strong base, such as NaOH. The solids content of the electrocoating formulation is also determined by heating the sample to dryness. If the polyamide acid salt in the electrocoating formulation is the salt of a weak base, such as amine, the amount of salt groups is determined by potentiometric titration of another portion of electrocoating composition dissolved in phenol containing 10% water, and using methanolic methane sulfonic acid as titrant. The single end point indicates the amount of neutralizing weak base in the given sample. The amount of non-neutralized acidic species in one gram of weak base neutralized formulation is defined as meq titratable acidic species/g less the meq titratable weak base/g.

The nonneutralized acidic species per g of solids is determied as $$N = \frac{\text{meq nonneutralized acidic species/g formulation}}{\text{meq solids/g formulation}}$$

The excess nonneutralized acidic species, E, per g solids is the difference of the values for $N_F$, determined on the freshly prepared electrocoating formulation and $N_D$ determined on a deteriorated electrocoating composition or $N_A$ determined on an anion-exchanged species $$E_D = N_D - N_F \text{ and } E_A = N_A - N_F$$

As shown by the drawing as previously described, under continuous electrocoating conditions, the polyamide acid salt bath can be maintained by continuously flowing the polyamide acid salt bath through a bed of the anion-exchange resin. The restored electrocoating mixture can then be electrodeposited to produce an electrodeposit having at least about 15% by weight of polyamide acid salt solids. It has been found that in the absence of the anion exchange treatment of the present invention, the appearance and quality of cured polyimide films which have been electrodeposited from a partially deteriorated coating composition are often acceptable on an anode which is electrocoated in a batch process and which can be given a suitable program cure. However, when a continuous length of copper or aluminum foil, wire, or strip is electrocoated from a deteriorated coating bath, the excessive amount of high boiling organic solvent associated with the electrodeposit cannot be flashed off rapidly in the curing tower and instead drains down the incoming wet electrodeposit, producing irregular streams of liquid which destruct the uniformity of the wet deposit. As a result, the cured films carry streaks of varying thickness and are unacceptable as electrical insulation. A convenient test, therefore, in determining whether a polyamide acid is suitable for producing or making a polyimide film by electrodeposition is to measure the polyamide acid solid in the electrodeposit. If the weight percent of solids is less than about 15%, then the likelihood of the streaking occurring when the polyamide acid conductor is cured is greatly enhanced.

In order that those skilled in the art will be better able to practice the invention, the following examples are given by way of illustration and not by way of limitation. All parts are by weight.

EXAMPLE 1

A polyamide acid was prepared by pouring a solution of 51.5 parts of methylenedianiline in 781 parts of dry N-methylpyrrolidone onto b 86.3 parts of benzophenone tetracarboxylic acid dianhydride powder which was being slowly stirred. The mixture was then stirred rapidly with external cooling. Based on method of preparation, there was obtained a polyamide acid solution having about 15% by weight of polyamide acid which had 3.89 meq of acid per gram of polymer solids as determined by titration of the solution.

An electrocoating composition was made by diluting 83.3 parts of the above polyamide acid solution with 173 parts of N-methylpyrrolidone. There was then added 6 parts of a one normal aqueous ammonium hydroxide solution followed by the slow addition of 242 parts of distilled water. The final composition was a stable emulsion containing 2.5% polyamide acid, 48.8% of N-methylpyrrolidone, 48.7% water and an amount of ammonia equivalent to 12.5% of the amide acid groups.

An electrocoating test was prepared from the above composition using a strip of aluminum 1 inch wide as an anode and a 1 inch wide platinum strip as the cathode. The two electrodes were separated by a distance of about ½ inch and were emerged to a depth of 1 inch in the electrocoating bath. A d.c. current of 40 ma was passed for 1 minute. A copper strip 1 inch wide was also used in place of the aluminum strip and electrocoated in the same manner. The aluminum and copper anode having a wet electrodeposit, were weighed and the samples were then heated for 1 minute at 125° C and for 5 minutes at 250° C. A cured polyimide film smooth and glossy was formed on both the aluminum strip and the copper strip. In addition, the solids content in the wet electrodeposit on the copper strip was 29% and on the aluminum was 35%.

After the electrocoating bath had been stored at room temperature for 5 days, an electrocoating test was again carried out on the aluminum. The weight of the cured polymer deposit was about 52% of the weight of the film obtained from the fresh electrocoating bath. The solids content in the wet electrodeposit on the aluminum strip was now only 12%. The electrocoating polyamide acid salt bath was then allowed to rest two additional days at room temperature. The bath was then divided into 100 part portions. Into each of the 100 part polyamide acid salt portions there was added 5 parts of a particular anion exchange resin. All of the exchange resins were of the styrene-divinylbenzene type, but each of the resins had a different cross-link density, based on the percent moisture retained by the resin in its chloride form. In addition, the various resins were also characterized by the functional groups contained on the resin which were either in quaternary ammonium form or in the amine form. There was employed about 5 grams of each of the resins, per 100 gram portion of the deteriorated electrocoating bath. All of the anion exchange resins had been treated with aqueous sodium hydroxide to convert them to the hydroxy form and had been washed with distilled water to remove the sodium hydroxide. Each of the resin-electrocoating composition mixtures was stirred for one hour to determine the ability of the respective resins to improve the weight percent of solids in the wet electrodeposit. The results obtained are shown in Table 1 below where the control indicates that no anion exchange resin was employed, "CLD" indicates cross-link density in terms of wt% of retained water of the resin, "FG" indicates functional groups on the resin, and "QA" indicates a quaternary ammonium.

TABLE 1

| Resin | CLD (%) | FG | % Solids in Wet Deposit |
|---|---|---|---|
| Control | — | — | 12 |
| A | 59–65 | QA | 25 |
| B | 56–62 | " | 24 |
| C | 40–50 | " | 12 |
| D | 40–50 | Amine | 12 |

A — Amberlite IRA 401S Mf'g by the Rohm & Haas Co.
B — Amberlite IRA 904 Mf'g by the Rohm & Haas Co.
C — Amberlite IR45 Mf'g by the Rohm & Haas Co.
D — Rexyn 201 Mf'g by the Fisher Scientific Co.

The above results show that in instances where the cross-link density of the resin was sufficiently low to provide at least a containment of 50%, based on the ability of the resin to retain water after it had been immersed under water as determined by the increase in its dry weight, that percent solids in the wet electrodeposit was substantially increased. In instances where the resin had a higher cross-link density sufficient to reduce the absorbed water to 50% or below, no change was obtained in the electrocoating composition as a result of the anion exchange resin treatment.

The anion-exchange resin was filtered from composition A. All the compositions were again stored at room temperature for 3 weeks. An electrocoating test with composition A free of the anion exchange resin indicated that only 11% of the solids were obtained in the electrodeposit. Composition A was then treated with an additional 5 part portion of the same anion exchange resin and the electrodeposit on an aluminum anode indicated a solids content of 29%, showing that the electrocoating composition was restored.

Electrocoating tests were also made with the remaining compositions after a total of 7 weeks from the initial electrocoating test in Table 1 where the anion exchange resins were not removed from the electrocoating compositions. Composition B containing a macrorecticular anion exchange resin as distinguished from the gel form, which characterized anion exchange resins A, C and D, provided a wet electrodeposit with 16% solids and a smooth uniform cured film. Composition C and D resulted in electrodeposits having less than 10% solids. The control composition which showed only 4% solids in the electrodeposit on both copper and aluminum anodes was treated with approximately 5 parts of resin D, by stirring the composition in the presence of the resin for about 1 hour. It was found that the composition was completely restored giving a wet electrodeposit containing 33% and 27% solids on aluminum and copper respectively and the cured films were smooth and uniform in appearance.

EXAMPLE 2

A completely imidized amide-imide polymer was prepared by stoichiometric reaction of toluene diisocyanate with a prepolymer prepared from two moles of trimellitic anhydride and one mole methylenedianiline. Electrocoating composition was prepared by adding aqueous sodium hydroxide to N-methylpyrrolidone solution of the amide-imide polymer, followed by slow addition of distilled water. The final composition was a solution containing 5% polymer solids, 63% N-methylpyrrolidone, 32% water, and 0.8 meq sodium hydroxide per g polymer. Electrocoating tests on this coating solution, according to the procedure of Example 1, provided a wet electrodeposit on aluminum containing 21% solids. After 8 weeks storage at room temperature, the solids content in the wet electrodeposit was reduced to 11%. Following the procedure of Example 1, 100 gram portion of the deteriorated electrocoating composition was stirred with approximately 5 grams of resin A for three hours. Electrocoating tests with the treated composition after the resin had been filtered off gave a wet electrodeposit of 22% solids.

EXAMPLE 3

A partly imidized amide-imide polymer resulting from the reaction of substantially equal molar amounts of trimellitic anhydride and methylene dianiline, was found by titration to contain 1.11 meq amide acid units and 1.48 meq imide groups per gram of polymer solids. The procedure used in titrating the polymer is described in Boldebuck U.S. Pat. No. 3,892,716, assigned to the same assignee as the present invention. An electrocoating test was performed on a composition containing 5% of the partly imidized amide acid polymer, 47.5% of N-methylpyrrolidone, 47.5% water and an amount of triethanol amine equivalent to 67% of the amide acid groups of the original polymer. There was obtained 20% solids in the wet electrodeposit. After the polyamide acid electrocoating formulation was allowed to rest for 1½ months at room temperature, it was found that only 11% solids were obtained following the procedure of Example 1. After an additional 1½ months of storage at room temperature, the deteriorated electrocoating composition was stirred for 2 hours with resin A of Example 1 employing about 5 parts of resin per 100 parts of electrocoating composition following the procedure of Example 1. The composition was then electrocoated and there was obtained a wet deposit containing 17% solids indicating that the electrocoating bath had been restored.

EXAMPLE 4

An electrocoating composition containing 7.5% by weight of an imidized amide-imide polymer, as described in Example 2, having 0.8 meq of sodium hydroxide per gram of solids, 30.8% water and 61.7% N-methylpyrrolidone, which had not been used for electrocoating, but which had been resting for 3 years at about 5° C was diluted with additional N-methylpyrrolidone and water. A sample of the original formation had given a weight percent solids of 24.5% in an electrodeposit. The electrodeposit from the stored formulation contained 9.3% solids. The resulting composition after dilution with solvent and water contained about 5% by weight solids and had a ratio of 2 parts of N-methylpyrrolidone per part of water.

The above electrocoating composition was treated in accordance with Example 1 with 5 parts of anion exchange resin A per 100 parts of electrocoating composition over a period of 1 hour. It was found that the weight percent solids in the electrodeposit increased to 15.9%. The electrocoating composition was then treated with an additional 5 parts anion exchange resin A per 100 parts of composition in accordance with the same procedure. It was found that the weight percent solids in the electrodeposit increased further to 23% by weight.

Although the above examples are limited to only a few of the very many variables within the scope of the method of the present invention, it should be understood that the present invention is directed to treatment of a much broader class of polyamide acid salt compositions as set forth in the description preceding these examples and the use of a much broader class of anion exchange resins as previously described.

What we claim as new and desire to secure by Letters Patent of the United States is:

1. A method of restoring a polyamide acid salt electrocoating bath, which is incapable of providing an electrodeposit having at least 15% solids, which has deteriorated over a shelf period of at least several days at ambient temperature, to produce a polyamide acid salt electrocoating composition capable of providing an electrodeposit with greater than 15% by weight solids, or maintaining an electrocoating bath which is being used continuously to electrocoat an aluminum or copper conductor under ambient conditions, which comprises contacting the polyamide acid salt bath with an anion exchange resin for time sufficient to reduce, or maintain the excess non-neutralized carboxylic acid of the polyamide acid salt to less than 0.45 meq of titratable carboxylic acid, per gram of polyamide acid salt, where the anion exchange resin has a cross-link density sufficient to contain from about 50–70% by weight water based on the total weight of water and dry weight of resin.

2. A method in accordance with claim 1, where the polyamide acid salt is a base neutralized imidized amide-imide polymer resulting from reaction of toluene diisocyanate with a prepolymer prepared from 2 moles of trimellitic anhydride and one mole of methylene dianiline.

3. A method in accordance with claim 1, where the polyamide acid salt is a base neutralized imidized amide-imide resulting from the reaction of substantially equal molar amounts of trimellitic anhydride and methylene dianiline.

4. A method in accordance with claim 1, where the polyamide acid salt is a base neutralized polyamide acid resulting from the reaction of substantially equal moles of an organic dianhydride selected from the class of benzophenone dianhydride and pyromellitic dianhydride and an organic diamine selected from the class of methylene diamine, oxydianiline and meta-phenylene diamine.

5. A method in accordance with claim 1, where the anion exchange resin is the reaction product of styrenedivinylbenzene having quaternary ammonium hydroxide functional groups.

6. A method in accordance with claim 1, which comprises, continuously flowing an electrocoating bath of a polyamide acid salt of an imidized amide-imide polymer prepared by the reaction of stoichiometric amounts of toluene diisocyanate with a prepolymer of two moles of trimellitic anhydride and one mole of methylene dianiline, through an anion exchange resin bed in the form of a styrene-divinyl benzene reaction product with quaternary ammonium hydroxide functionality and having a cross-link density capable of retaining 50–70% by weight water, based on the weight of the water and the dry weight of the resin.

7. A method in accordance with claim 1, where there is employed from 1–15 parts of anion exchange resin per 100 parts of bath.

* * * * *